US005095377A

United States Patent [19]

Kobayashi et al.

[11] Patent Number: 5,095,377

[45] Date of Patent: Mar. 10, 1992

[54] METHOD OF DRIVING A FERROELECTRIC LIQUID CRYSTAL MATRIX PANEL

[75] Inventors: Yoshinori Kobayashi, Hirakata; Naohide Wakita, Osaka; Yoshihiro Gohara, Toyono, all of Japan

[73] Assignee: Matsushita Electric Industrial Co., Ltd., Osaka, Japan

[21] Appl. No.: 561,576

[22] Filed: Aug. 2, 1990

[51] Int. Cl.[5] ..... G02F 1/13; G09G 3/36

[52] U.S. Cl. ..... 359/56; 359/85; 340/784

[58] Field of Search ..... 350/332, 333, 350 S; 340/784, 805

[56] References Cited

U.S. PATENT DOCUMENTS

| | | | |
|---|---|---|---|
| 4,638,310 | 1/1987 | Ayliffe et al. | 350/333 |
| 4,701,026 | 10/1987 | Yazaki et al. | 350/333 |
| 4,705,345 | 11/1987 | Ayliffe et al. | 350/350 S |
| 4,709,995 | 12/1987 | Kuribayaski et al. | 350/333 |
| 4,725,129 | 2/1988 | Kondo et al. | 350/333 |
| 4,746,196 | 5/1988 | Umeda et al. | 350/333 |
| 4,770,502 | 9/1988 | Kitazima et al. | 350/333 |
| 4,904,064 | 2/1990 | Lagerwall et al. | 350/333 |
| 5,011,269 | 4/1991 | Wakita et al. | 350/350 S |

FOREIGN PATENT DOCUMENTS

| | | |
|---|---|---|
| 62-56936 | 3/1987 | Japan . |
| 62-56937 | 3/1987 | Japan . |

*Primary Examiner*—Stanley D. Miller
*Assistant Examiner*—Tai V. Duong
*Attorney, Agent, or Firm*—Wenderoth, Lind & Ponack

[57] ABSTRACT

In a method of driving a liquid crystal matrix panel, a group of voltage pulses are applied to each pixel connected to a scanning line during a reset period prior to a selection period so as to reset the state of each pixel before writing data. When the voltage pulse group contains a voltage pulse having a voltage whose absolute value is at least equal an absolute value of a threshold voltage of the liquid crystal, the group also contains, before or after the voltage pulse, a voltage pulse having a voltage whose absolute value is smaller than the absolute value of the threshold voltage and whose polarity is opposite to that of the former voltage pulse.

5 Claims, 11 Drawing Sheets

| SELECTION SIGNAL 110a | SELECTION SIGNAL 110b | SIGNAL 104 | OUTPUT OF MULITPLEXER 65 |
|---|---|---|---|
| 0 | 0 | 0 | $V_0$ |
| | | 1 | $4V_0$ |
| 0 | 1 | 0 | $V_0$ |
| | | 1 | 0 |
| 1 | 0 | 0 | $5V_0$ |
| | | 1 | $4V_0$ |
| 1 | 1 | 0 | $5V_0$ |
| | | 1 | 0 |

FIG. 9

| OUTPUT OF LATCH 62 | SIGNAL 104 | OUTPUT OF MULITPLEXER 63 |
|---|---|---|
| 0 | 0 | $V_0$ |
| | 1 | $4V_0$ |
| 1 | 0 | $5V_0$ |
| | 1 | 0 |

FIG. 10

| OUTPUT OF LATCH 72 | SIGNAL 104 | OUTPUT OF MULITPLEXER 73 |
|---|---|---|
| 0 | 0 | $2V_0$ |
| | 1 | $3V_0$ |
| 1 | 0 | 0 |
| | 1 | $5V_0$ |

METHOD OF DRIVING A FERROELECTRIC LIQUID CRYSTAL MATRIX PANEL

BACKGROUND OF THE INVENTION

1. Field of the Invention

The present invention relates to a method of driving a liquid crystal matrix panel which has by itself a memory property, such as a ferrodielectric liquid crystal panel, and is usable in a display device.

2. Description of the Prior Art

Recently in the field of information processing apparatus represented by computers and in the field of video equipment represented by television and video tape recorders, there is a growing demand for a thin-type display device of large display capacity.

As an example of conventional driving method of liquid crystal matrix panel, the driving method of ferrodielectric liquid crystal is described below.

Conventional high speed driving methods of bistable ferrodielectric liquid crystal matrix panel are 1) the method applying a high voltage capable of setting the liquid crystal in a desired state regardless of the display data before the selection period (e.g. see the Technical Research Report of Japan Society of Electronic Information and Communications, Vol. 87, No. 68), 2) the method of inverting the polarity sequence of the applied voltage at scanning period intervals while selecting two scanning electrodes simultaneously (e.g. see Japanese Laid-open Patent 63-151929), and 3) the method of applying a voltage having a duration capable of setting the liquid crystal in a desired state regardless of the display data before the selection period (e.g., see Japanese Laid-open Patent 62-56937).

However, in the driving method of 1), the driving voltage becomes high, so that it is difficult to integrate the drive circuit on a semiconductor chip. In the driving method of 2), the operation margin varies with the display pattern. In the driving method of 3), three different voltages must be applied to the scanning electrodes at the same time, and therefore a driver having a simple structure cannot be used.

SUMMARY OF THE INVENTION

It is hence a primary object of the invention to simplify the structure of the driver by making modifications on the applied voltage to set the liquid crystal in a desired state regardless of the display data before the selection period, so that two different voltages may be applied to the scanning electrodes at the same time.

To achieve the above object, the invention presents a method of applying to a pixel of liquid crystal a pulse voltage group for setting the pixel in a specified state regardless of a display data before the selection period, wherein if the pulse voltage group contains a first pulse voltage having a voltage whose absolute value is at least equal to an absolute value of a threshold voltage of the liquid crystal, the pulse voltage group also contains a second pulse voltage having a voltage whose absolute value is smaller than the absolute value of the threshold voltage of the liquid crystal and being opposite in polarity to the first pulse voltage immediately before or after the first pulse voltage.

In this method, there may be only two different voltages applied to the scanning lines at the same time, so that the driver structure can be simplified. With such a driver, a driving method of a liquid crystal matrix panel having a large operating margin at a high speed (one screen driving time=liquid crystal response time×number of scanning lines×2) can be realized.

BRIEF DESCRIPTION OF THE DRAWINGS

FIG. 9 and FIG. 10 are truth tables of the multiplexers of scanning line driver and signal line driver in the liquid crystal display device in FIG. 7;

DESCRIPTION OF THE PREFERRED EMBODIMENTS

Figures 1, 13:
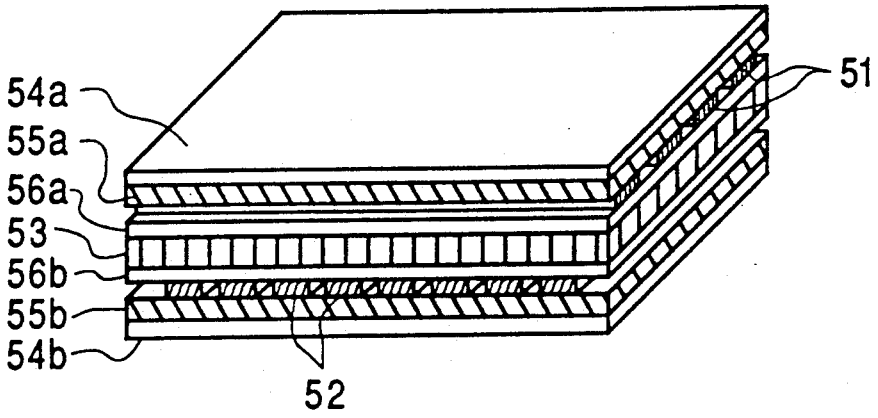
FIG. 1 is a structural diagram of a liquid crystal panel.
FIG. 13 is a truth table of the multiplexers of scanning line driver and signal line driver in the liquid crystal matrix display device in FIG. 11.
Figure 2:
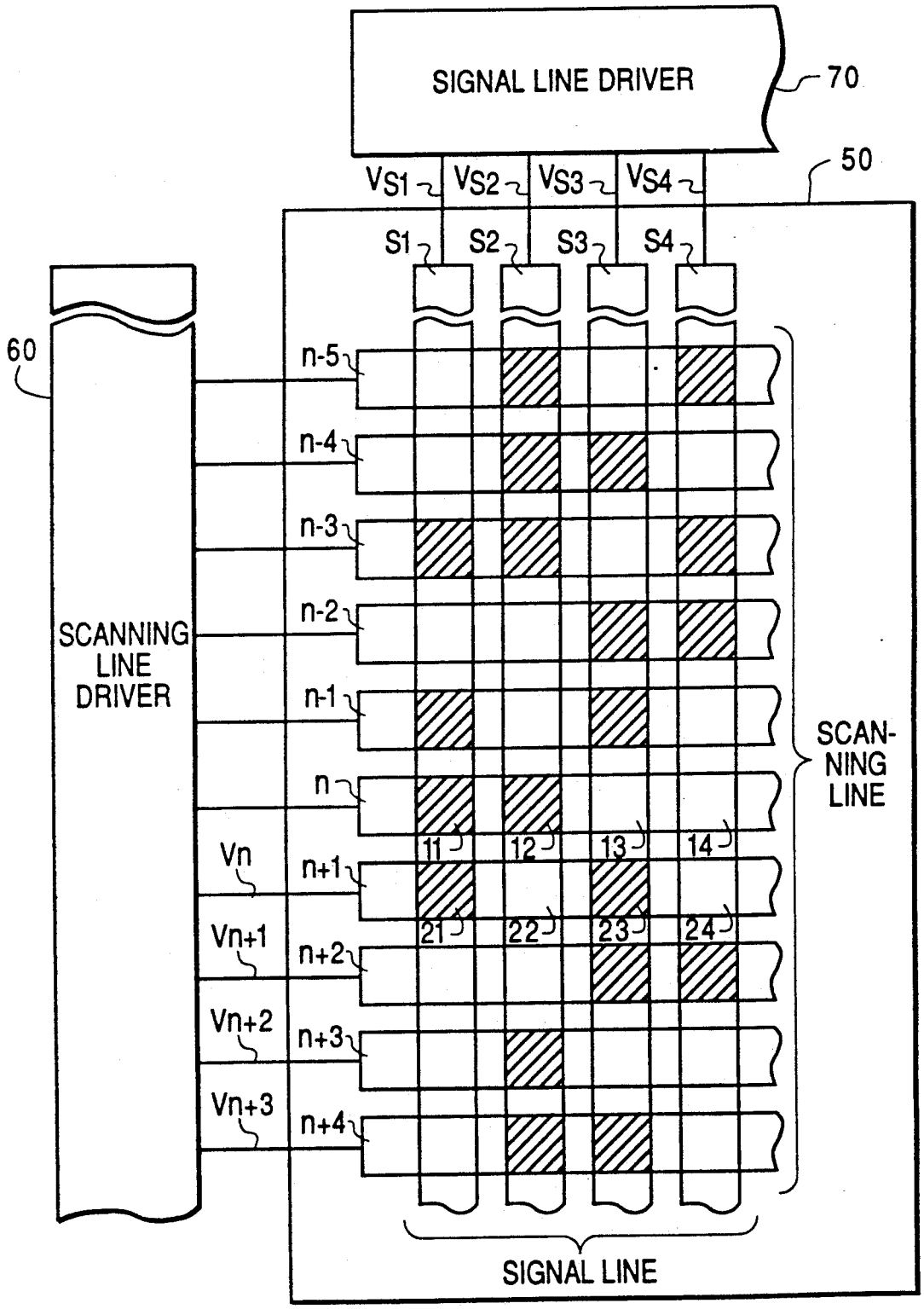
FIG. 2 is a schematic diagram of a liquid crystal matrix display device and a display pattern used in accordance with an embodiment of the present invention.
Figure 3:
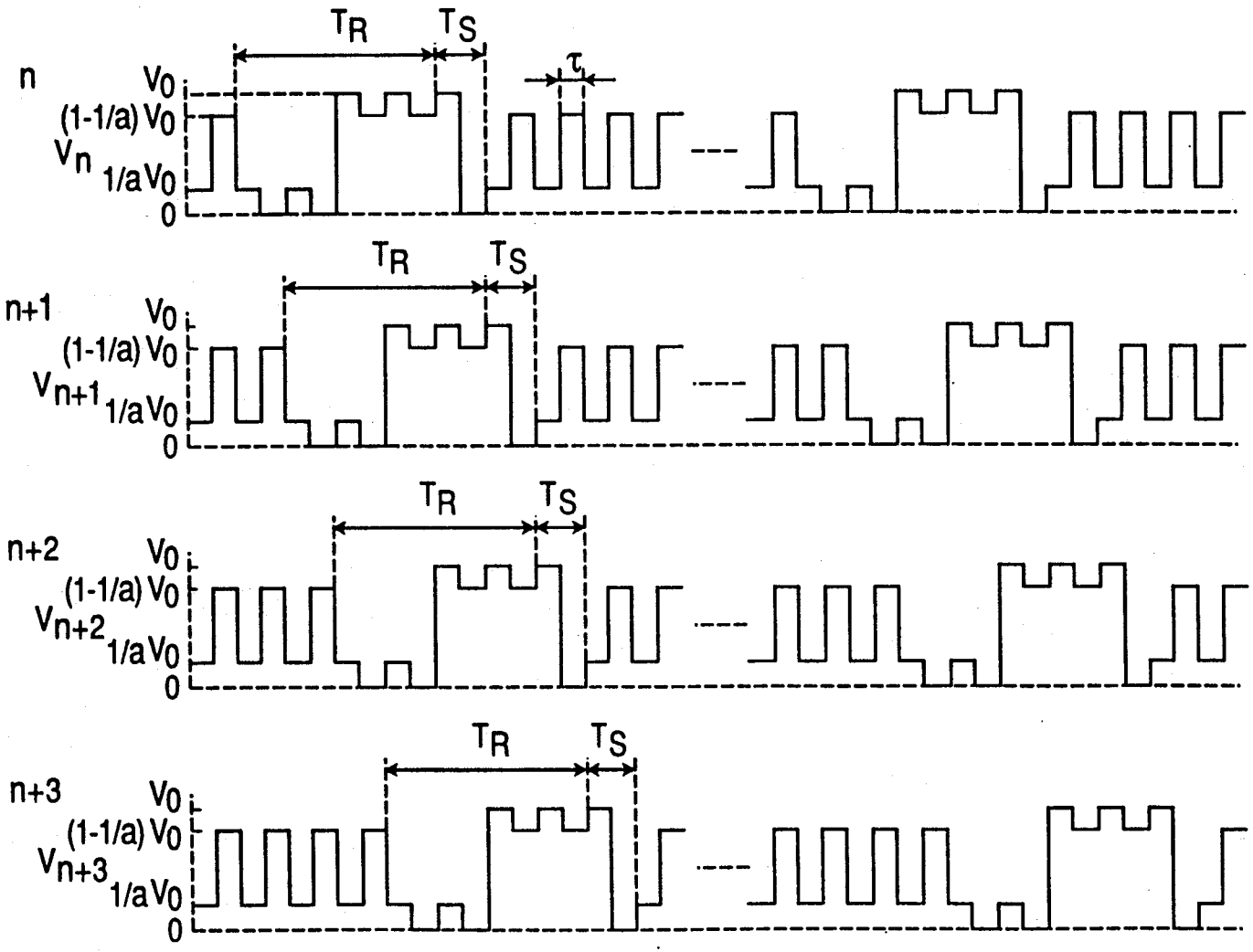
FIG. 3 is a waveform diagram of voltages applied to the scanning lines in accordance with an embodiment of the present invention.
Figure 4:
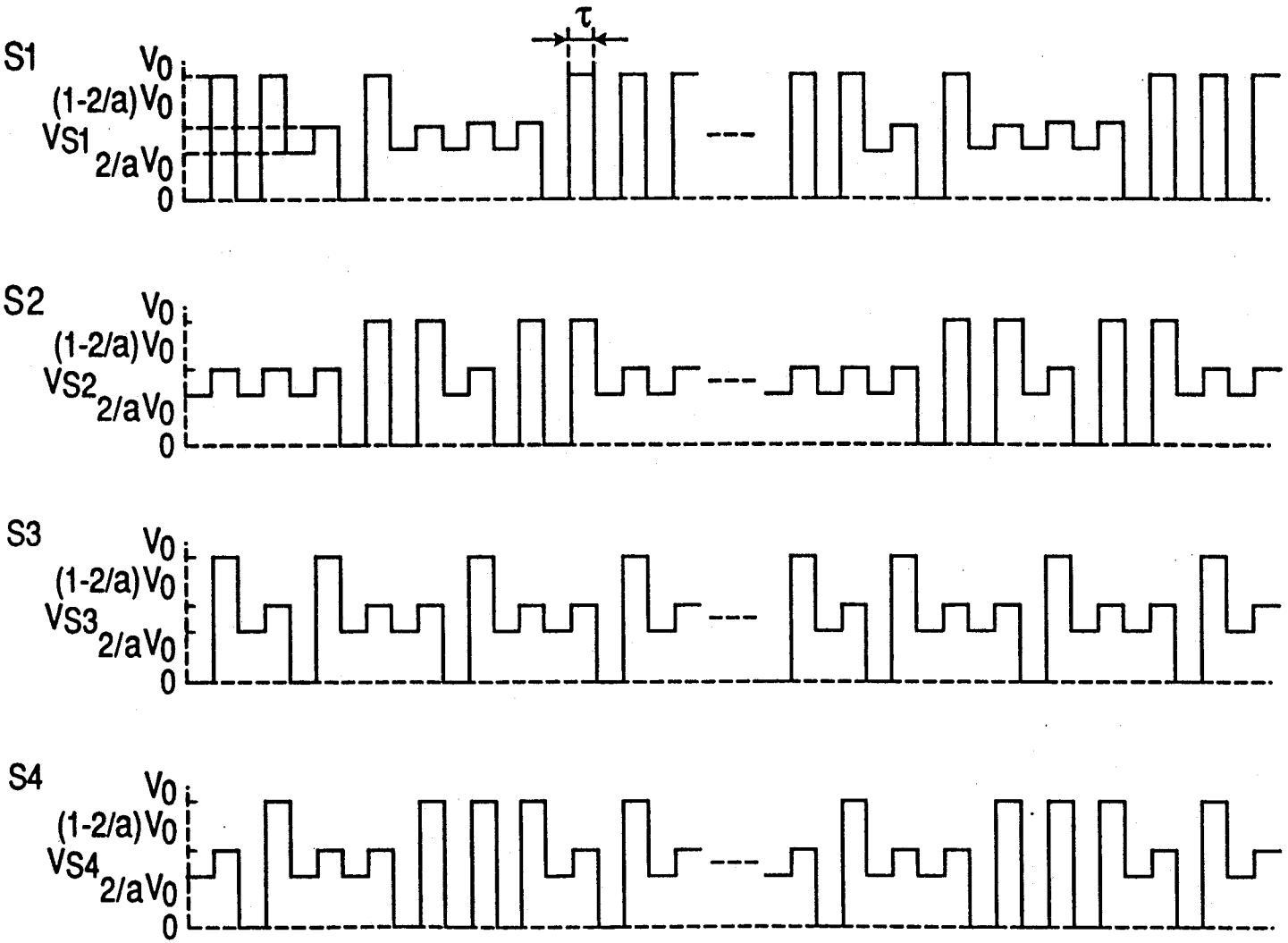
FIG. 4 is a waveform diagram of voltages applied to the signal lines for displaying a pattern in FIG. 2 in accordance with an embodiment of the present invention.
Figure 5:
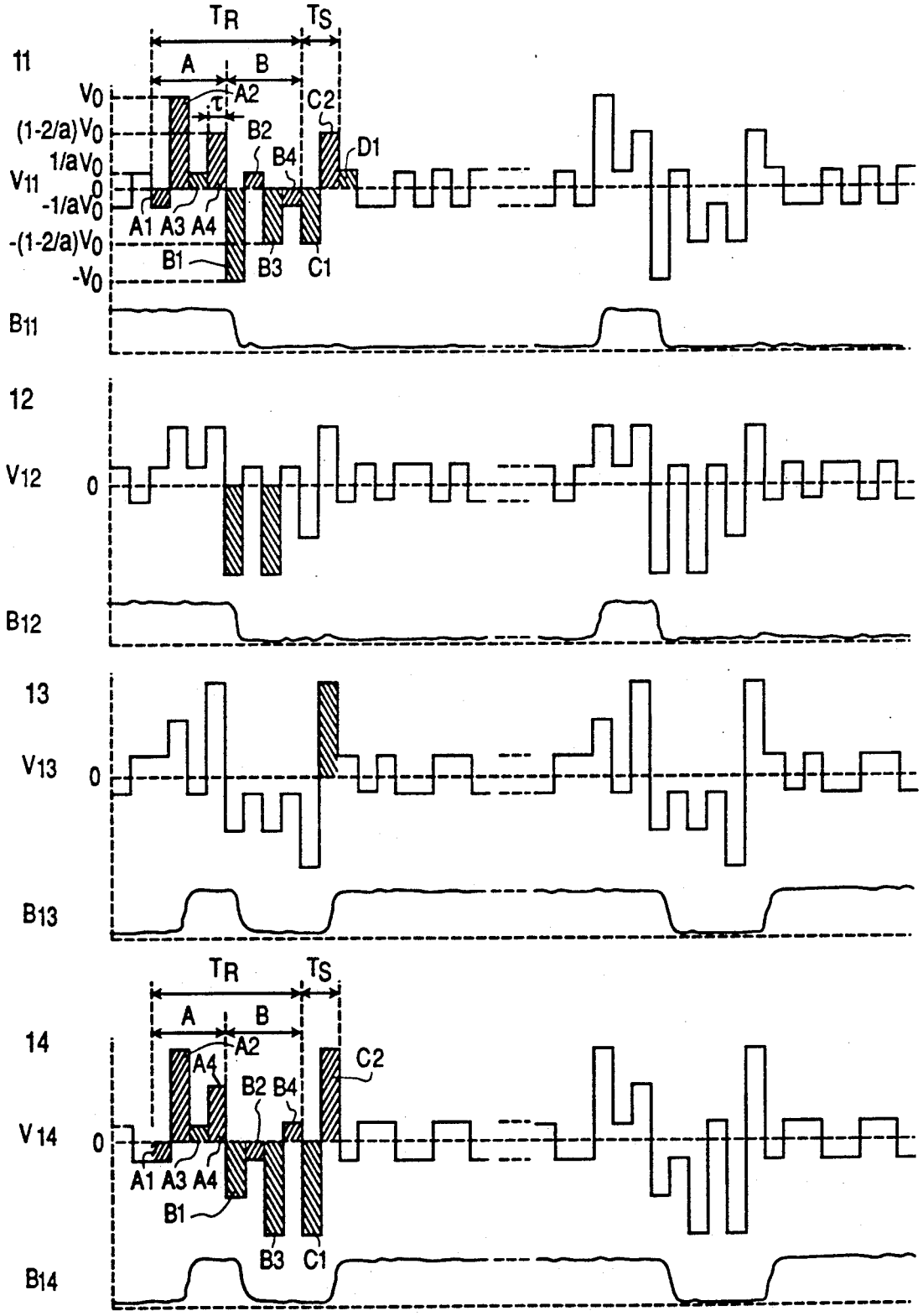
FIG. 5 and FIG. 6 are respectively a waveform diagram of voltage applied to the pixels in FIG. 2 in accordance with an embodiment of the present invention and a diagram of brightness changes of the pixels.

FIG. 2 is a schematic diagram of a display device in accordance with an embodiment of the present invention, which comprises a liquid crystal matrix panel 50, a scanning line driver connected to scanning lines of the panel, and a signal line driver 70 connected to signal lines of the panel. In the liquid crystal matrix panel 50, as shown in FIG. 1, scanning lines 51 of a patterned transparent conductive film are disposed beneath a glass substrate 55*a*, and an orientation film (an oriented organic macromolecular film) 56*a* is disposed further beneath. Signal lines 52 of a patterned transparent conductive film are disposed on a glass substrate 55*b*, and an orientation film 56*b* is disposed further thereon. A liquid crystal 53 is disposed so as to contact with the orientation films 56*a*, 56*b*, and polarizer plates 54*a*, 54*b* are disposed at outer sides of the glass substrates 55*a*, 55*b*. By the molecular orientation state of the liquid crystal 53 and the combination of the polarizer plates 54*a*, 54*b*, the "bright" state and "dark" state can be displayed. In the driving method of the invention in the case of displaying the display pattern as shown in FIG. 2 (a crossing area of a scanning line and a signal line is a pixel, and the shaded area indicates the "dark" state and the other area the "bright" state), FIG. 3 shows the waveform of the pulse voltages to be applied to scanning lines n, n+1, n+2, and n+3. FIG. 4 shows the waveform of the pulse voltages to be applied to signal lines s1, s2, s3, and s4; FIG. 5 shows the pulse voltages applied to pixels 11, 12, 13, and 14 (the differential voltage between the scanning line voltage and the signal line voltage), and FIG. 6 shows the pulse voltages applied to pixels 21, 22, 23, and 24, where a=5 in each of FIGS. 3, 4, 5 and 6.

The molecular orientation state of ferrodielectric liquid crystal showing a typical chiral smectic C phase as a liquid crystal possessing bistability [for example, +DOBABMC(+P-decyloxybenzylidene-P'-acyno-2-methylbutylcinnamate)] is characterized by the response to the time integration of the applied voltage of the same polarity (the time integration of the voltage between a positive-to-negative transition to the subsequent negative-to-positive transition or between a negative-to-positive transition to the subsequent positive-to-negative transition). In FIG. 5, if the minimum pulse width of the pulse signal applied to the pixel is $\tau$, the selection time of one scanning line (in which display data are to be written into the pixels connected to the scanning line) Ts is $2\tau$, the reset period $T_R$ (in which all of the pixels connected to the scanning line are reset to either a "dark" or "bright" state) is $8\tau$ (hence, $T_R=4Ts$), and the bias ratio a is 5, when the time integration value of the applied voltage of each pixel is equal to $-V_0\cdot\tau$, it is the "dark" state, and when it is at least equal to $V_0\cdot\tau$ or more, it is the "bright" state, and when the absolute value of the time integration of the applied voltage is smaller than $V_0\cdot\tau$, the previous state is retained. The value $V_0\cdot\tau$ or $-V_0\cdot\tau$ is called a "threshold value" of the liquid crystal to which the pixel is responsive to become the "bright" or "dark" state. First, the pixel 11 in FIG. 2 becomes "bright" state because, as shown in 11 in FIG. 5, the time integration value of the pulses A2, A3, A4 in pulse group A in the first half of the reset period $T_R$ of the applied voltage $V_{11}$ is $(9/5)\cdot V_0\cdot\tau$. The time integration value of the pulse B1 in pulse group B in the second half of the reset period $T_R$ is $-V_0\cdot\tau$, so that the pixel 11 is in its "dark" state. The time integration value of the next pulse B2 is $(1/5)\cdot V_0\cdot\tau$, so that the pixel 11 retains the "dark" state. The time integration value of the next pulses B3 and B4 and the pulse C1 of the selection period Ts is $-(7/5)\cdot V_0\cdot\tau$, so that the pixel 11 is in its "dark" state (actually it is not changed because it has been already in its "dark" state due to pulse B2). The time integration value of the next pulse C2 of the selection period Ts and the first pulse D1 of the succeeding non-selection period is $(4/5)\cdot V_0\cdot\tau$, so that the pixel 11 keeps its "dark" state. Afterwards, since the absolute value of the time integration of the applied voltage in the non-selection period is a maximum of $(2/5)\cdot V_0\cdot\tau$, the pixel 11 maintains its "dark" state. Incidentally, the pixel 14 in FIG. 2 first is in its "bright" state because, as shown in 14 in FIG. 5, the time integration value of the pulses A2, A3, A4 in the pulse group A in the first half of the reset period $T_R$ of the applied voltage $V_{14}$ is $(9/5)\cdot V_0\cdot\tau$. The time integration value of the pulses B1, B2, B3 in the pulse group B in the second half of the reset period $T_R$ is $-(9/5)\cdot V_0\cdot\tau$, so that the pixel 14 is in its "dark" state. The time integration value of the next pulse B4 is $(1/5)\cdot V_0\cdot\tau$, so that the pixel 14 retains its "dark" state. The time integration value of the pulse C1 of the selection period Ts is $-V_0\cdot\tau$, so that the pixel 14 is in its "dark" state (not changed because it has already been in its "dark" state due the pulses B1, B2, and B3). The time integration value of the pulse C21 of the selection period Ts is $V_0\cdot\tau$, so that the pixel 14 changes to its "bright" state. Afterwards, since the absolute value of the time integration of the applied voltage in the non-selection period is a maximum of $(2/5)\cdot V_0\cdot\tau$, the pixel 14 maintains its "bright" state. The other pixels in FIG. 2 are similarly set in the state determined by the pulses indicated by the hatching in FIG. 5 and FIG. 6, and the pattern in FIG. 2 is displayed. Meanwhile, as shown in FIG. 5 and FIG. 6, the pulse group A and pulse group B of the reset period $T_R$ differ in the pulse voltage waveform depending on the display data, but regardless of the display data, the voltage average values are respectively $(2/5)\cdot V_0$ and $-(2/5)\cdot V_0$, so that the voltage average value in the reset period $T_R$ is zero. Hence, the liquid crystal will not deteriorate due to electrochemical reaction.

Figure 6:
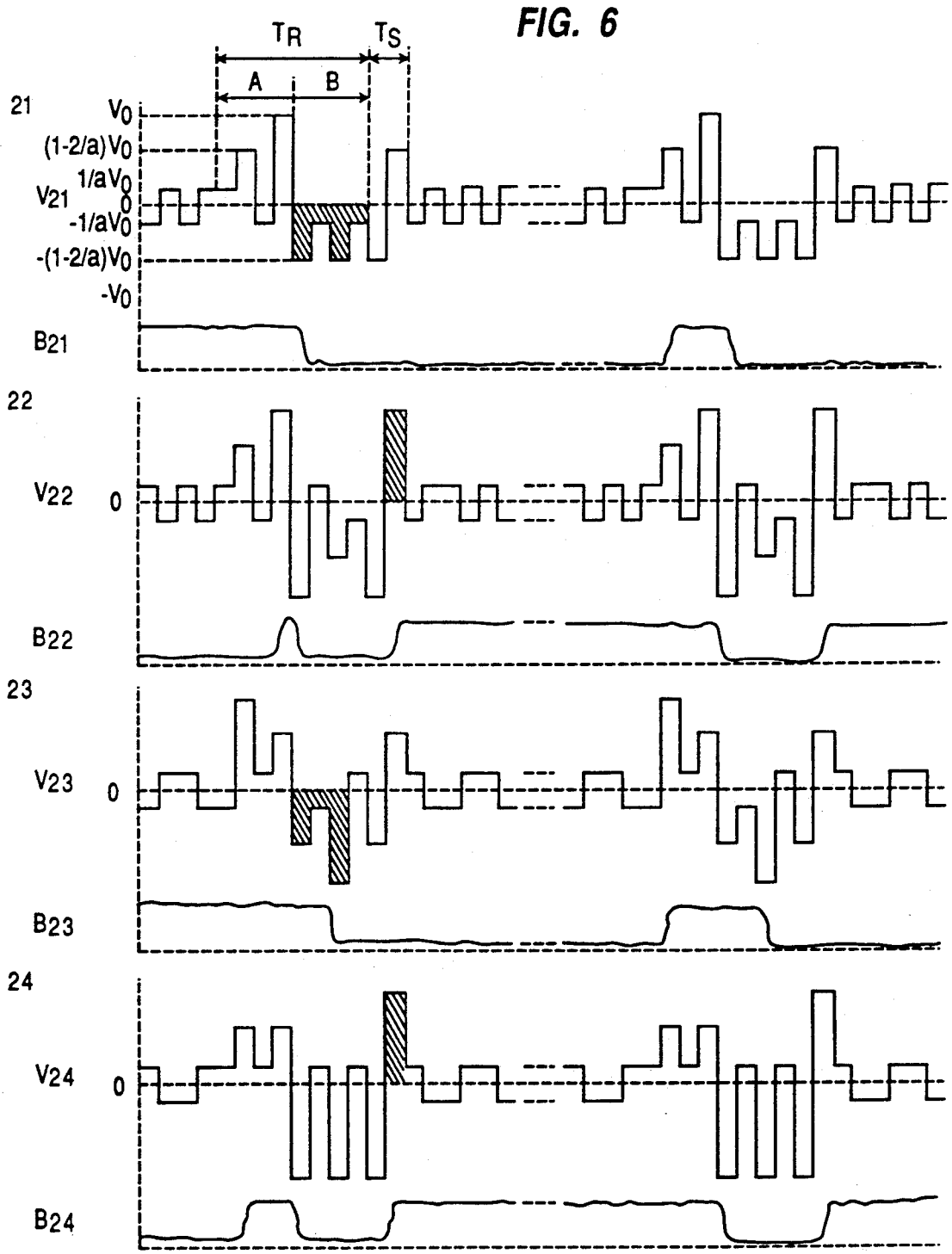

Referring to FIGS. 5 and 6, there are two noticeable features.

One feature is that all of the pixels (11-14) connected to a certain scanning line (n) are reset (forcedly placed in their "dark" state) during the reset period $T_R$ prior to the selection period $T_S$ in which the scanning line (n) is selected to be applied with a selection pulses (pulse voltages $V_0$,0 of the scanning signal $V_n$ in the selection period $T_s$ as shown in FIG. 3) and the state of each of the pixels (11-14) connected to the scanning line n is changed according to the signal voltages (S1, S2, S3 or S4) corresponding to a display data. The other feature is that, when the group of pulse voltages applied to a pixel in the reset period $T_R$ contains a pulse voltage having a time integration value of its voltage whose absolute value is at least equal to the absolute value of the threshold value ($|V_0\cdot\tau|$) of the liquid crystal, the same group of pulse voltages contains a pulse voltage having a time integration value of its voltage whose absolute value is smaller than the threshold value and whose polarity is opposite to that of the former pulse voltage immediately before or after the former pulse voltage. For example, in the case of the pixel 11 shown in FIG. 5, the group of voltages A1-A4, B1-B4 applied to the pixel 11 in the reset period $T_R$ contains a pulse voltage A2 having a time integration value of its voltage, $V_0\cdot\tau$, and a pulse voltage B1 having a time integration value of its voltage, $-V_0\cdot\tau$. The absolute value of the time integration value of voltage of each of the pulse voltages A2 and B1 is $|V_0\cdot\tau|$, which is equal to the absolute value of the threshold value of the liquid crystal. So, the group of voltages A1-A4, B1-B4 contains a pulse voltage A1 having a time integration valve of voltage, $-(1/5)\cdot V_0\cdot\tau$, before the pulse voltage A2, and a pulse voltage B2 having a time integration valve of voltage, $(1/5)\cdot V_0\cdot\tau$, after the pulse voltage B1. It is found from FIGS. 5 and 6 that the same rule as the above can be held in the case of any other pixel.

To apply the voltages to the pixels so as to satisfy the above-described condition, the pulse voltages applied to the scanning lines may be such that the number of different kinds of voltages applied to all of the scanning lines at the same time is only one or two. This can be easily seen from FIG. 3. Referring to the pulse voltages applied to the scanning lines n through n+3 at any timing, there are only one kind of voltage or two kinds of voltages during any timing. For example, during the first $\tau$ period in the reset period $T_R$ of the line n there is only one kind of voltage, $(1/5)V_0$, and during the next period there are only two kinds of voltages, 0 and $(4/5)V_0$. This is advantageous to simplify the circuit configuration of the driver circuit.

Incidently, in the driving method as described above, all of the voltage pulses applied to the scanning lines, the signal lines and the pixels have the same pulse width, τ. In this case, the voltage $V_0$ or $-V_0$ can be called a "threshold voltage" of the liquid crystal. If a voltage pulse applied to a pixel has a voltage whose absolute value is at least equal to the absolute value ($|V_0|$) of the threshold voltage, the pixel is responsive to the voltage pulse to be in a state determined by the polarity of the voltage pulse. Accordingly, the above-described second feature of the voltage pulses shown in FIGS. 5 and 6 can be said such that when a group of voltage pulses applied to a pixel in the reset period $T_R$ contains a voltage pulse having a voltage whose absolute value is at least equal to an absolute value of the threshold voltage of the liquid crystal, the group of voltage pulses also contains a voltage pulse having a voltage whose absolute value is smaller than the absolute value of the threshold voltage and having an opposite polarity to that of the former voltage pulse immediately before or after the former voltage pulse.

Figure 7:
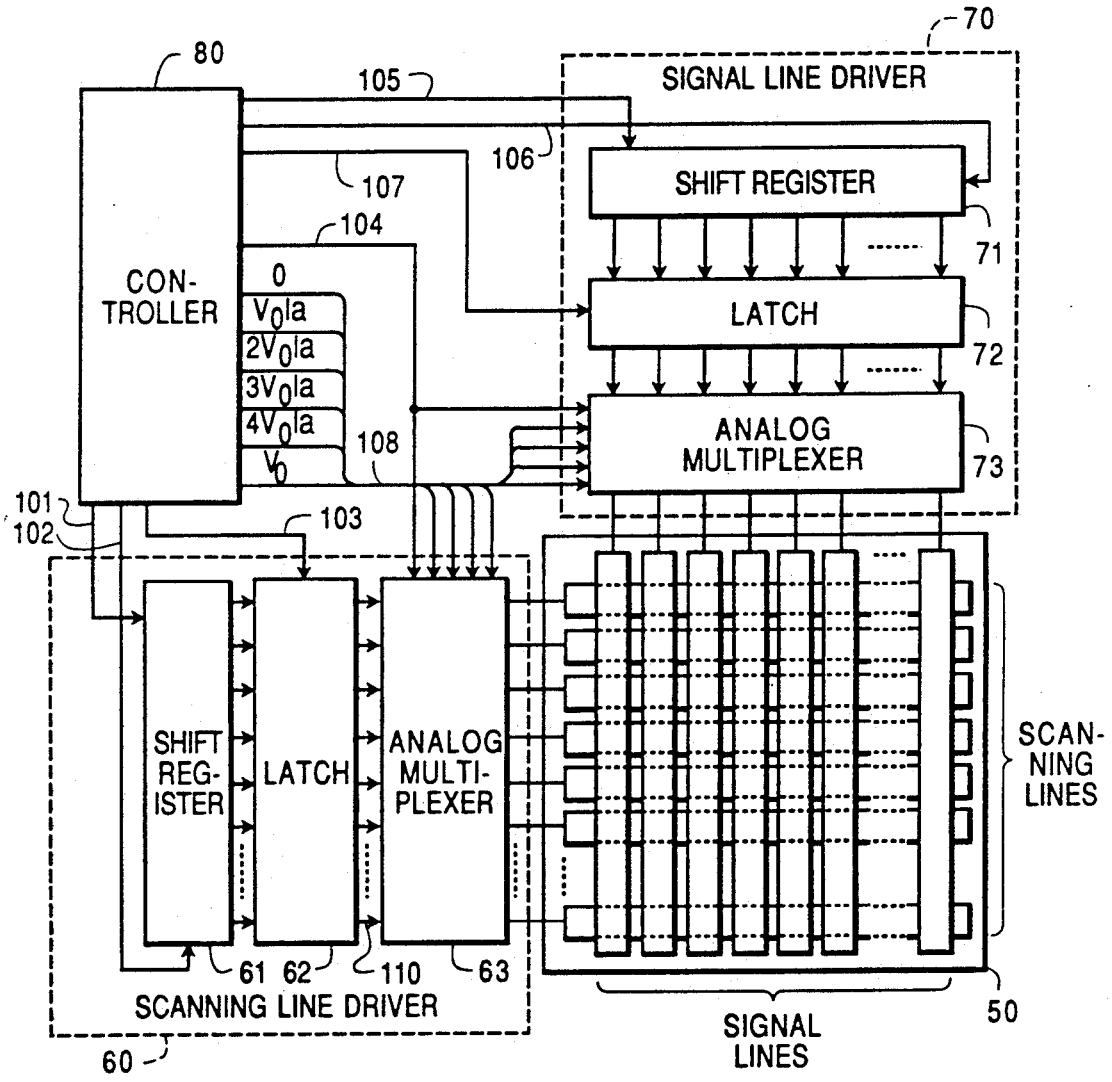
FIG. 7 is a block diagram of a liquid crystal matrix display device in accordance with an embodiment of the invention.
Figure 8:
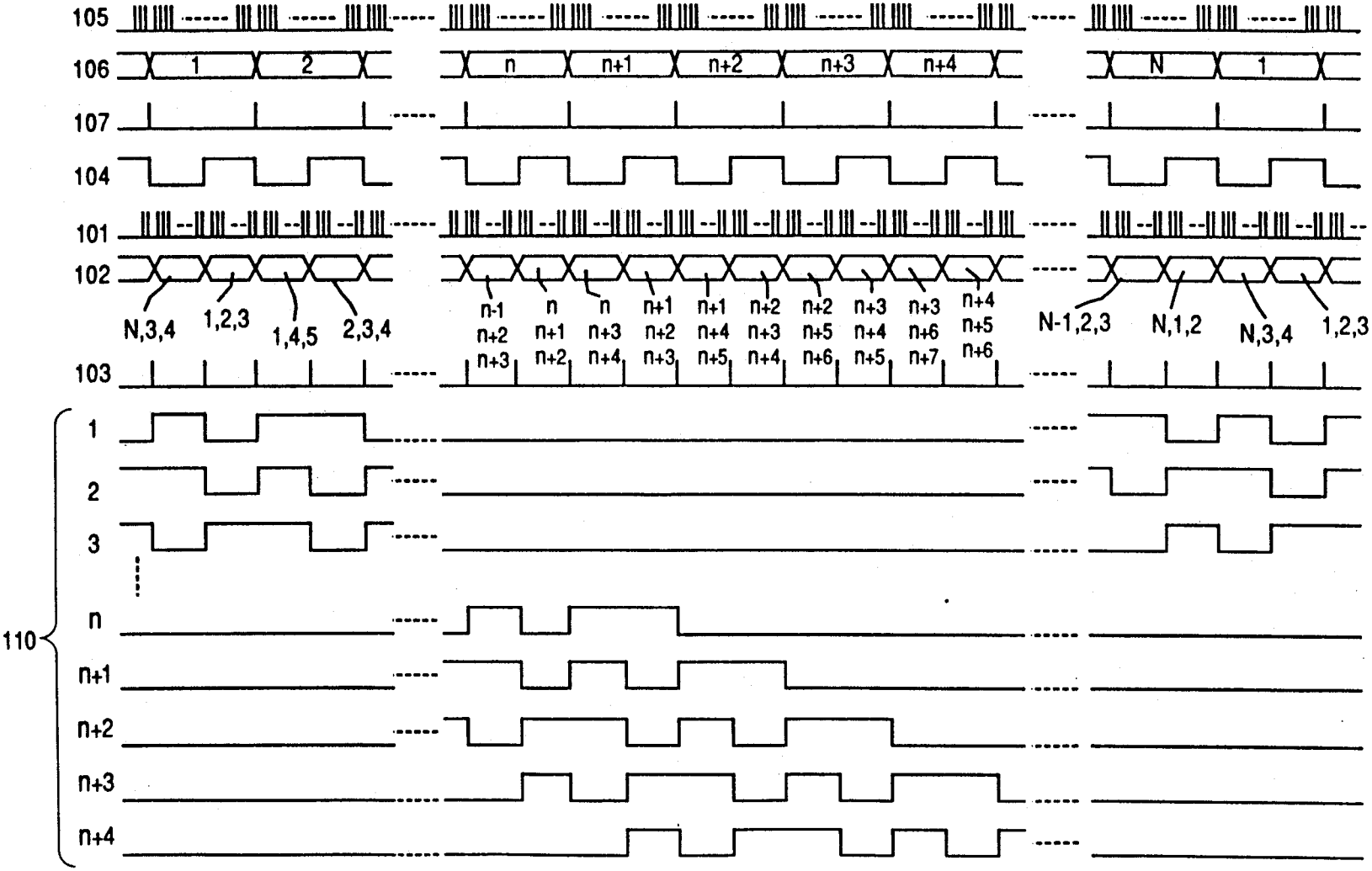
FIG. 8 is a timing chart of signals in the liquid crystal matrix display device in FIG. 7.

FIG. 7 is a block diagram of a display device in an embodiment of the invention, which comprises a liquid crystal matrix panel 50, a display unit comprising a scanning line driver 60 connected to the scanning lines and a signal line driver 70 connected to the signal lines, and a controller 80 for controlling the scanning line driver 60 and signal line driver 70. The voltage pulses applied to the scanning lines shown in FIG. 3 and the voltage pulses applied to the signal lines shown in FIG. 4 are respectively generated by the scanning line driver 60 and signal line driver 70. The scanning line driver 60 comprises a shift register 61 for sequentially shifting the scanning data 102 for resetting or selecting the scanning line in response to the shift clock 101, a latch 62 for taking in the output data of the shift register 61 by latch signal 103, and an analog multiplexer 63 for selecting one of four driving voltages [0, $(1/a)\cdot V_0$, $(4/a)\cdot V_0$, $V_0$] (where $a=5$) depending on the output data 110 and polarity inverting signal 104. The signal line driver 70 comprises a shift register 71 for sequentially taking in the display data 106 in response to the shift clock 105, a latch 72 for taking in the output data of the shift register 71 in response to the horizontal sync signal 107, and an analog multiplexer 73 for selecting one of four driving voltages [0, $(2/a)\cdot V_0$, $(3/a)\cdot V_0$, $V_0$] (where $=5$) depending on the output data and polarity inverting signal 104. FIG. 8 shows the timing chart of the driver control signals delivered from the display controller 80 in FIG. 7.

If the scanning line driver 60 and signal line driver 70 in FIG. 7 are operating according to the truth tables shown in FIG. 9 and FIG. 10, when the display data 106 is the data for pixels connected to the scanning line n as shown in FIG. 8, the scanning data 102 in which only $n-1$, $n+2$, and $n+3$ are "1" and only n, $n+1$, and $n+2$ are "1" is taken into the shift register 61, and when this data is taken into the latch 62 by the latch signal 103 in a half period of the horizontal sync interval, the operation in FIG. 3 is enabled. Here, the scanning line driver 60 and signal line driver 70 are identical in the circuit composition although the input signal and driving voltage are different as shown in FIG. 7. That is, only one type of driver may be employed, and the driver IC employed in nematic liquid crystal or the like can be used.

Figure 11:
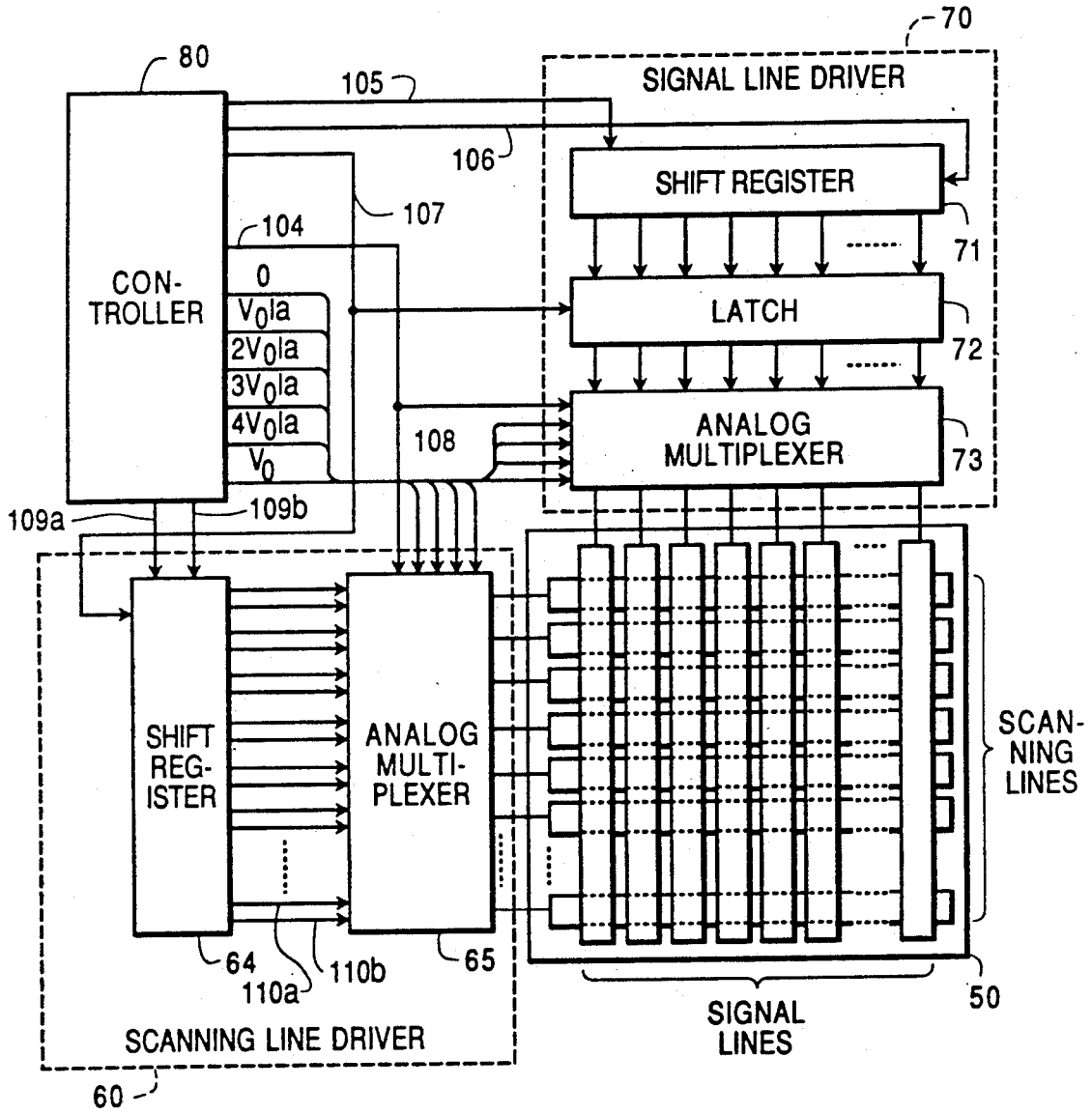
FIG. 11 is a block diagram of a liquid crystal matrix display device in accordance with another embodiment of the present invention.
Figure 12:
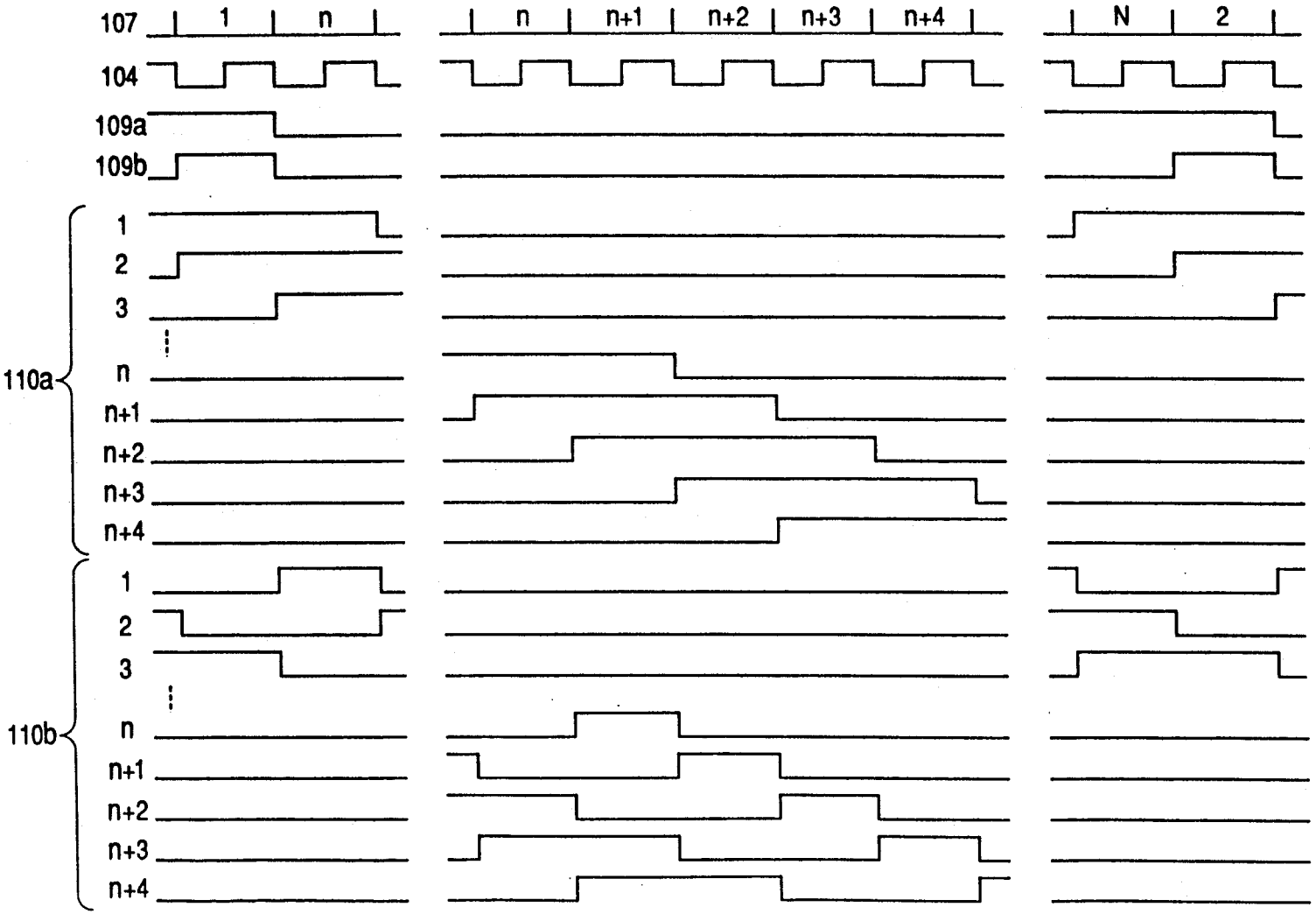
FIG. 12 is a timing chart of signals in the liquid crystal display device in FIG. 11.

Otherwise, the scanning driver 60 may also be composed as shown in FIG. 11, comprising a shift register 64 for sequentially shifting the scanning data in two bits 109*a*, 109*b* by the horizontal sync signal 107, and an analog multiplexer 65 for selecting one of four driving voltages [0, $(1/a)\cdot V_0$, $(4/a)\cdot V_0$, $V_0$] (where $a=5$) 108 depending on the output data 110*a*, 110*b* of the shift register 64, and polarity inverting signal 104. Here, if the scanning driver in FIG. 11 operates according to the truth table shown in FIG. 13, as shown in the timing chart of FIG. 12, the operation in FIG. 3 may be enabled when the scanning data 109*a* and 109*b* are sequentially shifted by the horizontal sync signal 107 as shown in the timing chart in FIG. 12.

In the foregoing embodiments, the reset period $T_R$ is set to four times the selection period Ts, but this is not limitative, and it may be at least any integer multiple of 2. The bias ratio a is chosen as 5 herein, but it is not limitative, and any value at least equal to 2 may be employed, and it may be varied depending on the threshold voltage of the liquid crystal or the reset period $T_R$.

What is claimed is:

1. A method of driving a liquid crystal matrix panel for realizing a desired light transmission state, in a liquid crystal matrix panel for forming pixels arranged in a matrix by interposing a ferrodielectric liquid crystal between a pair of substrates having scanning and signal lines on confronting surfaces, by applying to the pixels a first pulse voltage group possessing a sufficient voltage value and pulse width for setting all pixels selected by a desired scanning line in a reset period of the scanning line in one of either a "bright" or a "dark" state regardless of a voltage applied to a signal line, and either inverting or maintaining the same state by a display data by a second pulse voltage group applied to the pixels in a selection period;

wherein the application period of the first pulse voltage group is at least an integer multiple of 2 of the application period of the second pulse voltage group;

wherein the first pulse voltage group consists of a first half pulse voltage group and a second half pulse voltage group, and wherein when one of the first half and second half pulse voltage groups contains a first voltage pulse whose absolute value of voltage is at least equal to an absolute value of a threshold voltage of the liquid crystal, said one of the first half and second half pulse voltage groups also contains a second voltage pulse whose absolute value of voltage is smaller than the absolute value of the threshold voltage of the liquid crystal and whose polarity is opposite to that of the first voltage pulse, said second voltage pulse being applied immediately before said first voltage pulse in the first half pulse voltage group and immediately after said first voltage pulse in the second half pulse voltage group.

2. A method according to claim 1, wherein when a maximum voltage value of the voltage pulses applied to the pixels is $V_0$, said first voltage pulse is $V_0$ and said second voltage pulse is $-V_0/a$ (where $a \geqq 2$).

3. A method according to claim 2, wherein a voltage value of voltage pulses applied to the pixels in periods other than the periods of applying the first pulse voltage group and the second pulse voltage group is $\pm V_0/a$.

4. A method according to claim 1, wherein if said first voltage pulse is $+V_0$, said second voltage pulse immediately before or after said first voltage pulse of $+V_0$ is $-V_0/a$ (where $a \geqq 2$), and if said first voltage pulse is $-V_0$, said second voltage pulse immediately before or after said first voltage pulse of $-V_0$ is $+V_0/a$.

5. A method according to claim 1, wherein an average value of voltage of said first half pulse voltage group and an average volume of voltage of said second half pulse voltage group are the same in absolute value and reverse in polarity to each other so that an average value of voltage of said first pulse voltage group is zero.

* * * * *